US010022958B2

(12) United States Patent
Nitta et al.

(10) Patent No.: US 10,022,958 B2
(45) Date of Patent: Jul. 17, 2018

(54) INKJET HEAD AND INKJET RECORDING APPARATUS

(71) Applicant: TOSHIBA TEC KABUSHIKI KAISHA, Shinagawa-ku, Tokyo (JP)

(72) Inventors: Noboru Nitta, Tagata Shizuoka (JP); Shunichi Ono, Izu Shizuoka (JP); Teruyuki Hiyoshi, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/262,229

(22) Filed: Sep. 12, 2016

(65) Prior Publication Data

US 2017/0151778 A1 Jun. 1, 2017

(30) Foreign Application Priority Data

Nov. 26, 2015 (JP) ..... 2015-230792
Jun. 2, 2016 (JP) ..... 2016-111240

(51) Int. Cl.
*B41J 2/045* (2006.01)

(52) U.S. Cl.
CPC ..... *B41J 2/04541* (2013.01); *B41J 2/04581* (2013.01); *B41J 2/04588* (2013.01); *B41J 2202/10* (2013.01)

(58) Field of Classification Search
CPC .... B41J 2/14233; B41J 2/161; B41J 2/14209; B41J 2/1609; B41J 2002/14419; B41J 2/14201; B41J 2002/14225; B41J 2202/11; B41J 2/04581; B41J 2/04588; B41J 2002/14258; B41J 2002/14306; B41J 2/1433; B41J 2/14274
USPC ..... 347/9–11, 14, 44, 65, 68, 70–72
See application file for complete search history.

(56) References Cited

U.S. PATENT DOCUMENTS

| | | | |
|---|---|---|---|
| 5,767,871 | A | 6/1998 | Imai |
| 6,437,964 | B1 | 8/2002 | Takamura et al. |
| 6,504,701 | B1 | 1/2003 | Takamura et al. |
| 2001/0043242 | A1 | 11/2001 | Takahashi |
| 2012/0147075 | A1 | 6/2012 | Hiyoshi et al. |
| 2013/0002769 | A1 | 1/2013 | Koseki |

(Continued)

FOREIGN PATENT DOCUMENTS

| | | |
|---|---|---|
| JP | 10-315451 | 12/1998 |
| JP | 3283197 | 5/2002 |

OTHER PUBLICATIONS

Extended European Search Report for European Patent Application No. 16196910.0 dated Apr. 13, 2017.

*Primary Examiner* — Jannelle M Lebron
(74) *Attorney, Agent, or Firm* — Amin, Turocy & Watson LLP

(57) ABSTRACT

An inkjet head contains a piezoelectric member which alternately includes plural first grooves and plural second grooves respectively constituted by a pair of side surfaces and a bottom surface; a first electrode on at least one of a pair of the side surfaces of each first groove; a second electrode on the side surface to face the first electrode across the piezoelectric member of each second groove; and a driving circuit including plural first drivers for each first electrode and inputting a common first driving waveform to each first electrode, and plural second drivers for each second electrode and inputting a second driving waveform of each second electrode corresponding to print data to each second electrode.

15 Claims, 10 Drawing Sheets

(56) References Cited

U.S. PATENT DOCUMENTS

| | | | |
|---|---|---|---|
| 2014/0085379 | A1 | 3/2014 | Horiguchi |
| 2014/0125741 | A1 | 5/2014 | Horiguchi et al. |
| 2014/0160194 | A1 | 6/2014 | Ono et al. |
| 2014/0160195 | A1 | 6/2014 | Ono et al. |
| 2014/0176627 | A1 | 6/2014 | Ono et al. |
| 2014/0253619 | A1 | 9/2014 | Norigoe |
| 2015/0054872 | A1 | 2/2015 | Hiyoshi et al. |
| 2015/0116403 | A1 | 4/2015 | Hiyoshi et al. |

INKJET HEAD AND INKJET RECORDING APPARATUS

CROSS-REFERENCE TO RELATED APPLICATION

The present application is based upon and claims the benefit of priorities from Japanese Patent Application No. P2015-230792 filed on Nov. 26, 2015 and Japanese Patent Application No. P2016-111240 filed on Jun. 2, 2016, the entire contents of both of which are hereby incorporated by reference.

FIELD

Embodiments described herein relate generally to an inkjet head, an inkjet recording apparatus, and associated methods.

BACKGROUND

There is an inkjet head that ejects ink flowing into a plurality of grooves arranged in a piezoelectric member through a shear mode deformation of the piezoelectric member. In such an inkjet head, electrodes are formed on side walls of the grooves to sandwich the piezoelectric member. If a voltage is applied to a pair of electrodes that sandwich the piezoelectric member, the piezoelectric member is deformed. The inkjet head deforms the piezoelectric member to change pressure in the grooves to thereby eject the ink.

In the inkjet head with the foregoing configuration, as the piezoelectric member constituting the side wall of a groove that ejects ink is deformed, one side wall of each of two adjacent grooves to the groove is also deformed. Thus, it is possible that the ink is undesirably ejected from the two adjacent grooves. In an attempt to address this problem, there is an inkjet head that enables the ink to flow into every other groove.

The foregoing inkjet head inputs a driving waveform to the electrodes, respectively formed in a plurality of grooves of which the ink flows into, via a common electrode, and inputs a driving waveform corresponding to print data to the electrodes respectively formed in a plurality of grooves into which no ink flows. However, in a case in which the driving waveform is input from one driving circuit that drives the common electrode, a voltage drop which is generated in impedance of the common electrode and the driving circuit varies depending on the number of the piezoelectric members that are driven simultaneously. As a result, it is possible that a difference is generated in the driving waveforms input to the electrodes according to the print data. Thus, it is possible to impair reliability of print.

DETAILED DESCRIPTION

In accordance with an embodiment, an inkjet head comprises a piezoelectric member, a nozzle plate, an ink chamber, a plurality of first electrodes, a plurality of second electrodes and a driving circuit. The piezoelectric member includes alternately a plurality of first grooves and a plurality of second grooves respectively constituted by a pair of side surfaces and a bottom surface on the surface of the piezoelectric member. The nozzle plate blocks the surface of the piezoelectric member on which a nozzle is arranged at least in accordance with the position of the first groove. The ink chamber communicates with the first groove to supply ink. The first electrode is arranged on at least one of a pair of the side surfaces of each first groove. The second electrode is arranged on the side surface to face the first electrode across the piezoelectric member of each second groove. The driving circuit includes a plurality of first drivers that is respectively arranged for the first electrodes and respectively inputs a common first driving waveform to each first electrode, and a plurality of second drivers that is respectively arranged for the second electrodes and respectively inputs a second driving waveform of each second electrode corresponding to print data to each second electrode.

In accordance with another embodiment, an inkjet printing method for the inkjet head involves inputting the common first driving waveform to each of the plurality of first electrodes from the plurality of first drivers; and simultaneously inputting the second driving waveform to each of the plurality of second electrodes from the plurality of second drivers.

Hereinafter, the inkjet head and an inkjet recording apparatus according to the embodiment are described with reference to the accompanying drawings.

Figure 1:
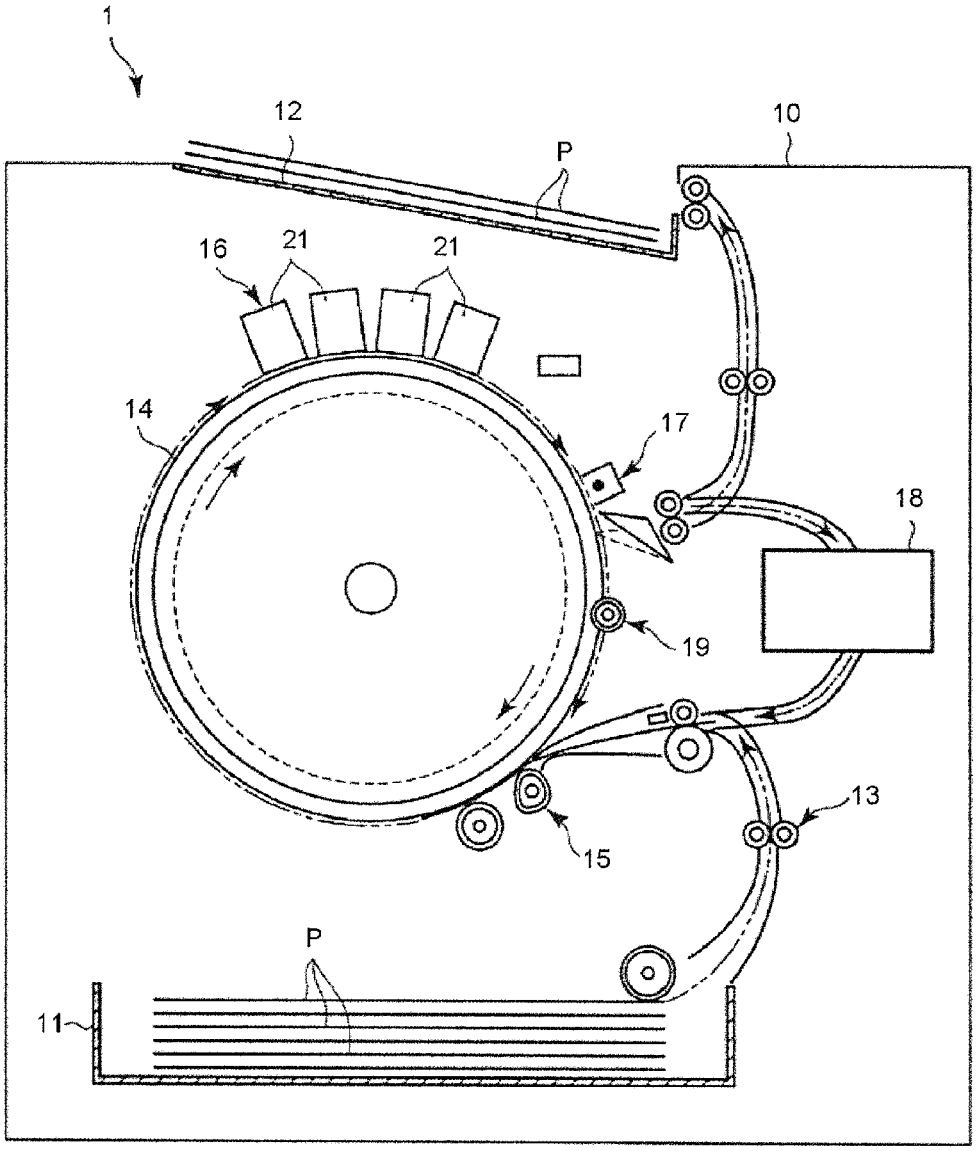
FIG. 1 is a diagram illustrating an example of the configuration of an inkjet recording apparatus according to an embodiment.
Figure 2:
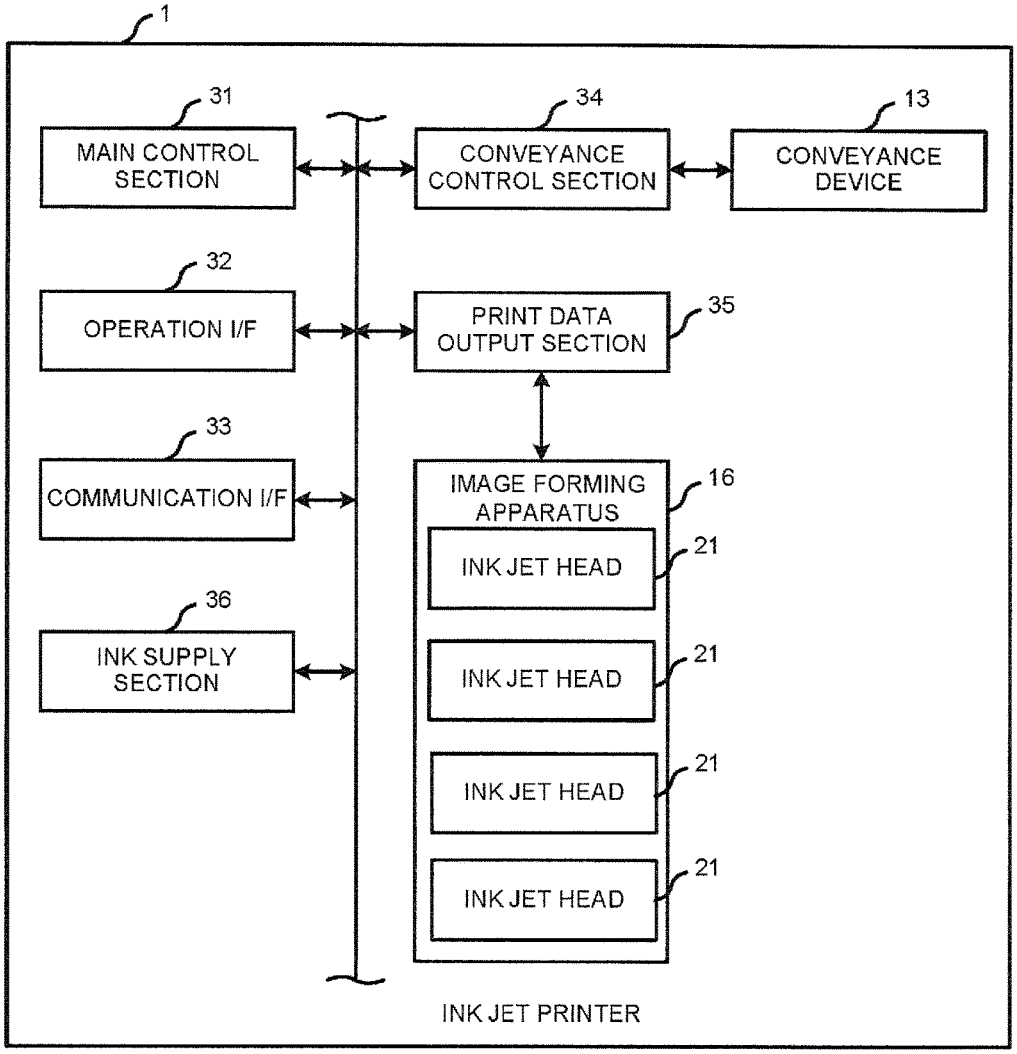
FIG. 2 is a diagram illustrating an example of the configuration of a control system of the inkjet recording apparatus according to the embodiment.

First, an inkjet printer 1 according to the embodiment is described. FIG. 1 is a view illustrating an example of the configuration of the inkjet printer 1 according to the embodiment. FIG. 2 is a view illustrating an example of the configuration of main sections of a control system of the inkjet printer 1.

The inkjet printer 1 is an example of the inkjet recording apparatus. Further, the inkjet recording apparatus is not limited to this and may be another apparatus such as a copier or facsimile machine.

As shown in FIG. 1, the inkjet printer 1, for example, conveys a recording paper P serving as an image receiving medium and carries out various processing such as an image forming processing and the like. The inkjet printer 1 is equipped with a housing 10, a paper feed cassette 11, a paper discharge tray 12, a conveyance device 13, a holding roller (drum) 14, a holding device 15, an image forming apparatus 16, a discharge peeling device 17, a reversing device 18 and a cleaning device 19. The inkjet printer 1 is further equipped with a main control section 31 as a main control system, an operation I/F 32, a communication I/F 33, a conveyance control section 34, a print data output section 35 and an ink supply section 36.

The paper feed cassette 11 houses a plurality of recording papers P. The paper feed cassette 11 is arranged inside, for example, the housing 10.

The paper discharge tray 12 is arranged on the housing 10. The paper discharge tray 12 houses a discharged recording paper P on which an image is formed by the inkjet printer 1.

The conveyance device 13 includes a plurality of guides and a plurality of conveyance rollers arranged along a route in which the recording paper P is conveyed. The conveyance rollers are driven by a motor that operates according to the control of the conveyance control section 34 to rotate to convey the recording paper P. A part of guides among a plurality of the guides are rotated through a motor that operates according to the control of the conveyance control section 34 to switch the conveyance path in which the recording paper P is conveyed. The conveyance device 13 conveys the recording paper P housed in the paper feed cassette 11 to the holding roller 14. Further, the conveyance device 13 conveys the recording paper P supplied from the holding roller 14 to the paper discharge tray 12 or the reversing device 18. The conveyance device 13, for example, switches a conveyance destination to which the recording paper P is conveyed between the paper discharge tray 12 and the reversing device 18 under the control of the conveyance control section 34.

The holding roller 14 includes a cylindrical frame formed by a conductor and a thin insulating layer (not shown) formed on the surface of the frame. The frame is grounded (connected with ground). The holding roller 14 conveys the recording paper P by rotating the frame in a state of holding the recording paper P on the surface of the frame.

The holding device 15 adsorbs the recording paper P conveyed from the conveyance device 13 on the surface of the frame of the holding roller 14 to hold it. For example, the holding device 15 adsorbs the recording paper P on the surface of the frame of the holding roller 14 through electrostatic force that is generated by charging the recording paper P after pressing the recording paper P against the frame of the holding roller 14.

The image forming apparatus 16 forms an image on the recording paper P conveyed by the holding roller 14. The image forming apparatus 16 includes a plurality of inkjet heads 21. The image forming apparatus 16 includes a plurality of inkjet heads 21 respectively corresponding to different colors, for example, cyan, magenta, yellow and black. The inkjet head 21 includes a nozzle that ejects ink. The nozzle for ejecting the ink of the inkjet head 21 is arranged in a direction opposite to the surface of the frame of the holding roller 14.

The image forming apparatus 16 forms an image on one surface of the recording paper P by ejecting the ink through the inkjet head 21 to the recording paper P held on the surface of the frame of the holding roller 14. On the basis of print data output from the print data output section 35, the image forming apparatus 16, enables each inkjet head 21 to operate to form an image corresponding to the print data on the recording paper P.

The discharge peeling device 17 discharges the electrostatic force of the recording paper P held on the surface of the frame of the holding roller 14 to peel the recording paper P off the holding roller 14. For example, the discharge peeling device 17 discharges the electrostatic force of the recording paper P by supplying an electric charge to the recording paper P, and peels the recording paper P off the holding roller 14 by inserting a pawl to a space between the recording paper P and the surface of the frame of the holding roller 14. The recording paper P peeled off the holding roller 14 is supplied to the conveyance device 13.

The reversing device 18 reverses front surface and back surface and/or front end and rear end of the recording paper P and supplies the reversed recording paper P to the holding roller 14. In other words, the reversing device 18 makes the surface of the recording paper P, peeled off the holding roller 14 by the discharge peeling device 17, on which the image is formed, face the surface of the frame of the holding roller 14, and then supplies the recording paper P to the holding roller 14.

The cleaning device 19 removes ink and paper dust adhered on the surface of the frame of the holding roller 14.

The main control section 31 controls the conveyance of the recording paper P by the conveyance device 13 of the inkjet printer 1 and the image formation on the recording paper P by the image forming apparatus 16. The main control section 31 is constituted by a processor such as a CPU, a program memory, a working memory, various interfaces and the like. The main control section 31 realizes various processing functions through the execution of programs stored in the program memory by the processor.

For example, the main control section 31 generates the print data for the image forming apparatus 16 to form the image according to data (e.g. a print instruction) received through the communication I/F 33. The print data is composed of, for example, a plurality of lines consisting of a plurality of pixels in parallel. The main control section 31 supplies the generated print data to the print data output section 35.

The operation I/F 32 is connected with an operation section (not shown). The operation I/F 32 supplies an operation signal corresponding to an operation input on the operation section to the main control section 31.

The communication I/F 33 is connected with a network or an electronic equipment (neither is shown). The communication I/F 33 can send or receive data to or from other electronic equipment directly or via the network. The communication I/F 33 is, for example, a LAN connector, a USB port and a wireless LAN module.

The conveyance control section 34 controls operations of the conveyance device 13. For example, the conveyance control section 34 controls the operation of the motor used to drive the conveyance roller of the conveyance device 13. Further, for example, the conveyance control section 34 controls the operation of the motor used to rotate the guide.

The print data output section 35 outputs the print data according to which the image forming apparatus 16 forms the image to the image forming apparatus 16. The print data output section 35 is equipped with, for example, an image memory for temporarily storing the print data. The print data output section 35 stores the print data supplied from the main control section 31 in the image memory, and successively outputs the print data stored in the image memory to the image forming apparatus 16.

The ink supply section 36 supplies the ink in an ink tank (not shown) for holding the ink to the inkjet head 21 of the image forming apparatus 16 on the basis of the control of the main control section 31. The ink supply section 36 is equipped with a tube that communicates with the ink tank and the inkjet head 21 and a pump that supplies the ink in the ink tank to the inkjet head 21 via the tube.

In the inkjet printer 1 with the foregoing configuration, the main control section 31 generates the print data in a case of receiving the data for instructing printing via the communication I/F 33. The main control section 31 supplies the generated print data to the image forming apparatus 16 via the print data output section 35. The conveyance control section 34 picks up the recording paper P from the paper feed cassette 11 and supplies the picked-up recording paper P to the holding roller 14. The holding roller 14 conveys the recording paper P in a state of holding the recording paper P. The image forming apparatus 16 enables each inkjet head 21 to operate to form the image on the recording paper P conveyed by the holding roller 14 according to the print data.

Next, the detailed configuration of the inkjet head 21 is described. FIG. 3 to FIG. 8 are diagrams illustrating examples of the configuration of the inkjet head 21.

Figure 3:
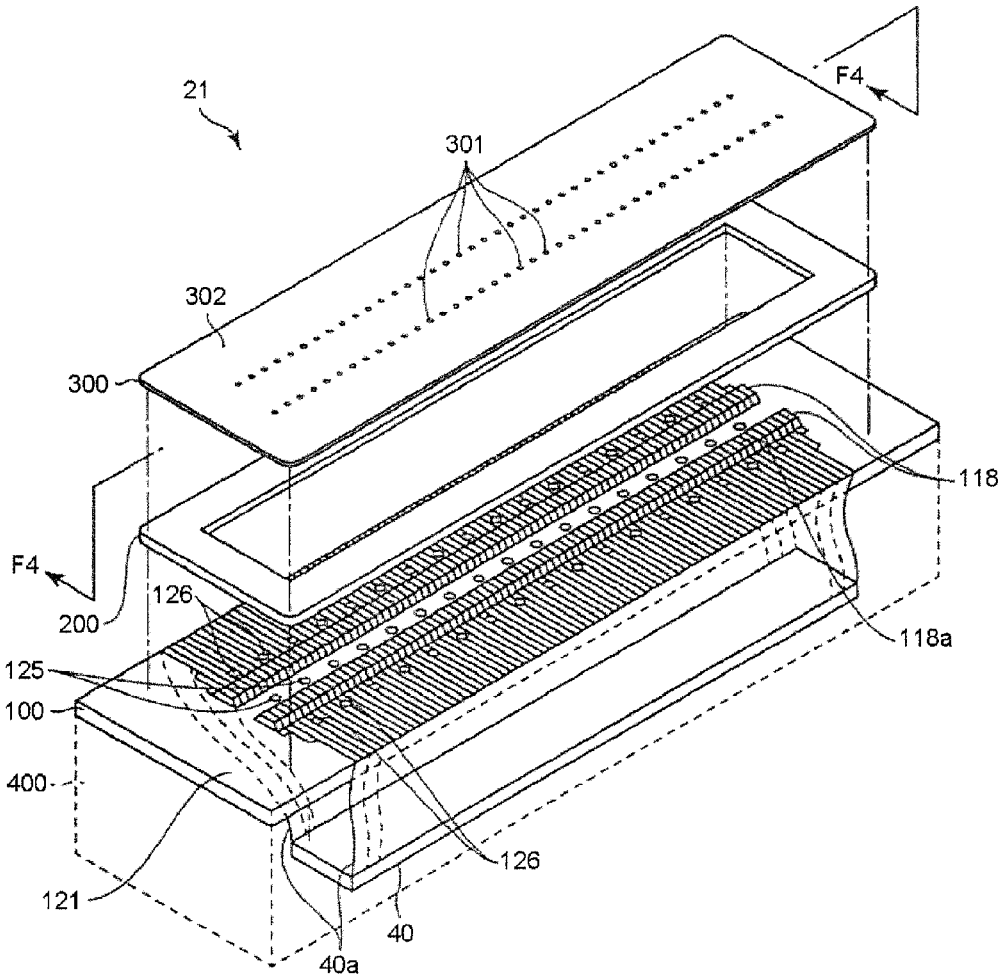
FIG. 3 is a diagram illustrating an example of the configuration of an inkjet head according to the embodiment.

FIG. 3 is an exploded perspective view of the inkjet head 21.

As shown in FIG. 3, the inkjet head 21 is, for example, a side-shooter type on-demand inkjet head with a shear mode piezoelectric device. The inkjet head 21 which is loaded in the foregoing inkjet printer 1 ejects the ink towards the recording paper P.

The inkjet head 21 is equipped with a base material 100, a nozzle plate 300, a frame member 200 and a housing 400. In the housing 400, a driving circuit 40 for making the inkjet head 21 operate is arranged.

The inkjet head 21 is equipped with two piezoelectric members 118 extending in a longitudinal direction of the base material 100 at the center of amounting surface 121 of the base material 100.

Further, as will be described in detail below, an ink chamber 116 (FIG. 7) encircled by the base material 100, the nozzle plate 300 and the frame member 200 is arranged inside the inkjet head 21.

As shown in FIG. 3, the base material 100 is formed into a rectangle plate shape. In the present embodiment, alumina is used as a material of the base material 100. The material of the base material 100 is not limited to this, and may be, for example, other semiconductor materials such as silicon carbide (SiC) and germanium substrate. Further, the material of the base material 100 may be other materials such as ceramic, glass, quartz, resin, or metal. For example, nitride, carbide or oxide such as zirconia, silicon carbide, silicon nitride, or barium titanate can be used as the ceramic. For example, a plastic material such as ABS (acrylonitrile butadiene styrene), polyacetal, polyamide, polycarbonate or polyether sulfone can be used as the resin. For example, aluminum or titanium can be used as the metal. Further, in a case in which the base material 100 is made from a metal material, it is necessary to cover the mounting surface 121 with the insulating material.

The base material 100 includes the mounting surface 121. Two rows of the piezoelectric members 118 are parallelly arranged on the mounting surface 121. The piezoelectric members 118 of which cross sections in the direction between the rows are trapezoid are parallelly arranged to be separated from each other. A plurality of supply ports 125 and a plurality of discharge ports 126 are arranged on the base material 100 along the longitudinal direction of the piezoelectric members 118.

The plurality of the supply ports 125 is parallelly arranged between the two piezoelectric members 118, that is, along the center of the base material 100 in the longitudinal direction of the base material 100. Each supply port 125 penetrates the base material 100 to fluidly communicate with the ink tank (not shown) via manifold (not shown) and tube (not shown). In other words, the ink supplied from the ink tank to the inkjet head 21 through the supply port 125 flows into the ink chamber 116.

As shown in FIG. 3, two rows of the discharge ports 126 between which the supply ports 125 are sandwiched are parallelly arranged at the outside of the two piezoelectric members 118. Each discharge port 126 penetrates the base material 100 to fluidly communicate with the ink tank (not shown) via manifold (not shown) and tube (not shown), and discharges the ink in the ink chamber 116 to the ink tank. Thus, the ink circulates between the ink tank and the ink chamber 116 through the supply port 125 and the discharge port 126.

As shown in FIG. 3, the nozzle plate 300 is formed by, for example, a rectangular thin film made from polyimide. The material of the nozzle plate 300 which is not limited to this may be, for example, other semiconductor materials such as silicon carbide (SiC) and germanium substrate. As other resin materials, for example, a plastic material such as other types of polyimide, ABS, polyacetal, polyamide, polycarbonate and polyethersulfone can be used. Further, as the ceramic, for example, nitride or oxide such as zirconia, silicon carbide, silicon nitride and barium titanate can be used. Further, the nozzle plate 300 may be formed by a metal material. As the metal material, for example, aluminum, SUS or titanium can be used. Further, in a case in which the nozzle plate 300 is made from the metal material, an insulating material is used between the nozzle plate 300 and a first electrode 134 or a second electrode 135.

An ink repellent film (not shown) is formed on a surface 302 of the nozzle plate 300 at the ink ejection side. The ink repellent film is formed by, for example, silicon-based liquid-repellent material having liquid repellency or a fluorine-containing organic material.

The nozzle plate 300 is arranged to face the mounting surface 121 of the base material 100 across the frame member 200. The nozzle plate 300 includes a plurality of nozzles 301 that penetrates the nozzle plate 300. Two rows of plural nozzles 301 are parallelly arranged along the longitudinal direction of the nozzle plate 300.

As shown in FIG. 3, the frame member 200 is formed into a rectangular frame shape with, for example, nickel alloy. The material of the frame member 200 is not limited to this, and may be, for example, other semiconductor materials such as silicon carbide (SiC) and germanium substrate. As other resin materials, for example, a plastic material such as other types of polyimide, ABS, polyacetal, polyamide, polycarbonate and polyethersulfone can be used. Further, as the ceramic, for example, nitride or oxide such as zirconia, silicon carbide, silicon nitride and barium titanate can be used. The frame member 200 is arranged between the mounting surface 121 of the base material 100 and the nozzle plate 300. The size of the frame member 200 is large enough to encircle the two piezoelectric members 118 and all the nozzles 301. In a case in which the frame member 200 is made from the metal material, an insulating material is used between the frame member 200 and a first wiring 136 or a second wiring 137.

The piezoelectric member 118 is formed by, for example, lead zirconate titanate (PZT). The piezoelectric member 118 is formed by bonding two plate-like piezoelectric bodies in polarization directions opposite to each other. The piezoelectric member 118 according to the present embodiment has a rod-like outline extending in the longitudinal direction. A piezoelectric material is not limited to this, and various kinds of piezoelectric materials such as PTO (PbTiO3: lead titanate), PMNT (Pb (Mg1/3Nb2/3) O3-PbTiO3), PZNT (Pb (Zn1/3Nb2/3) O3-PbTiO3), ZnO and AlN can be used.

As shown in FIG. 3, the piezoelectric member 118 is bonded to the mounting surface 121 of the base material 100. For example, epoxy adhesive having thermoset is used as the adhesive.

Figure 4:
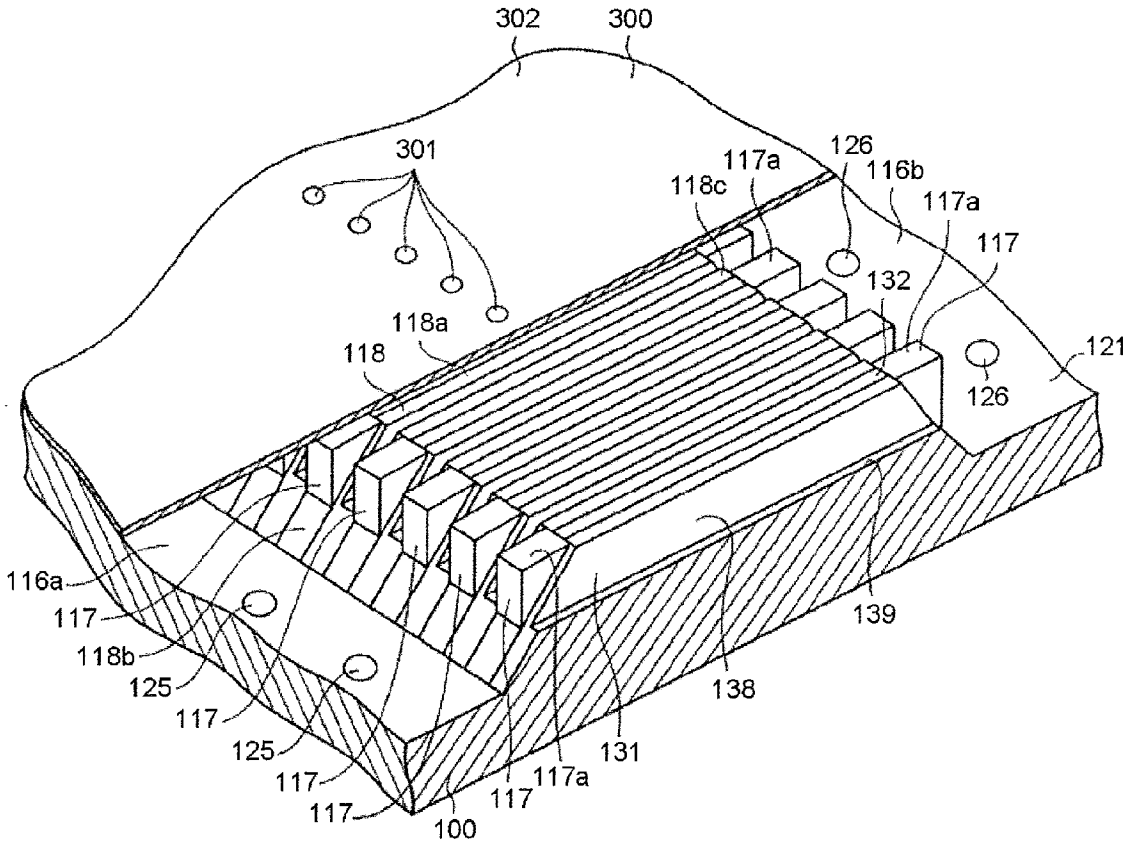
FIG. 4 is a diagram illustrating an example of the configuration of a part of the inkjet head according to the embodiment.

FIG. 4 is a perspective view enlargedly illustrating the vicinity of the piezoelectric members 118 two rows of which are parallelly arranged on the base material 100. In FIG. 4, a part of the nozzle plate 300 is omitted in order to easily observe the configuration of the piezoelectric member 118.

As shown in FIG. 4, the piezoelectric member 118 includes a top surface 118*c* parallel to the mounting surface 121 of the base material 100 and two inclined surfaces 118*b* that incline in such a way as to spread from both ends of the top surface 118*c* in the lateral direction towards the mounting surface 121. A plurality of first grooves 131 (hereinafter, referred to as pressure chambers 131) and a plurality of second grooves 132 (hereinafter, referred to as air chambers 132) extending in the lateral direction of the base material 100 are alternately arranged in the piezoelectric member 118. Both ends of each of the first groove 131 and the second groove 132 are connected with the inclined surfaces 118*b*. In the present embodiment, the first groove 131 and the second groove 132 are formed into the same shape. Besides, the shapes of the first groove 131 and the second groove 132 may be different from each other. If a viewpoint is changed, the piezoelectric member 118 includes a plurality of side walls 133 which is used to form these first grooves 131 and second grooves 132. The side wall 133, in other words, is a protrusion arranged between the first groove 131 and the second groove 132.

Furthermore, wall materials 117 are arranged at both ends of the second grooves 132. The wall material 117 seals the both ends of the second groove 132. The wall material 117 includes a top surface 117*a* arranged at the same surface as the top surface 118*c* of the piezoelectric member 118. The top surface 118*c* of the piezoelectric member 118 and the top surface 117*a* of the wall material 117 are bonded with the nozzle plate 300. In this way, the ink filled into the ink chamber 116 is prevented from penetrating into the second groove 132.

Figure 5:
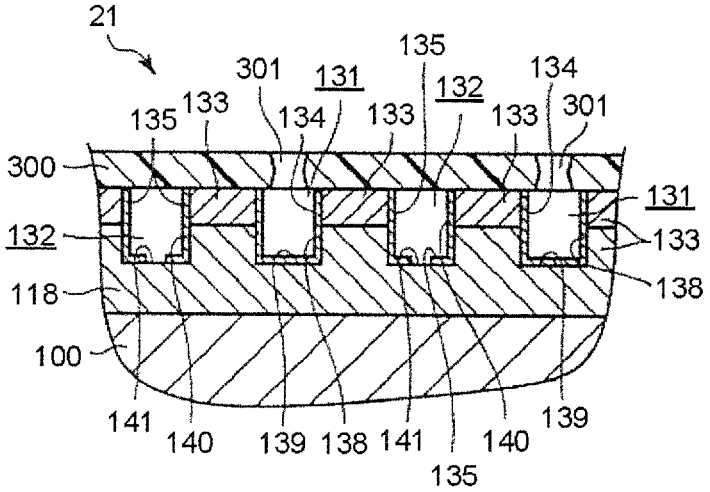
FIG. 5 is a diagram illustrating an example of the configuration of a part of the inkjet head according to the embodiment.

FIG. 5 is an enlarged cross-sectional view illustrating a part of the inkjet head 21 shown in FIG. 3 cut off along F4-F4 in the longitudinal direction.

As shown in FIG. 5, the nozzles 301 of the nozzle plate 300 are arranged in such a manner that one nozzle 301 communicates with one first groove 131. That is, the nozzle plate 300 includes two rows of the nozzles 301 corresponding to the first grooves 131 arranged on two rows of the piezoelectric members 118. On the other hand, no nozzle corresponds to the second groove 132.

Hereinafter, the configuration of the ink chamber 116 and a flow direction of the ink are described in detail.

Figure 6:
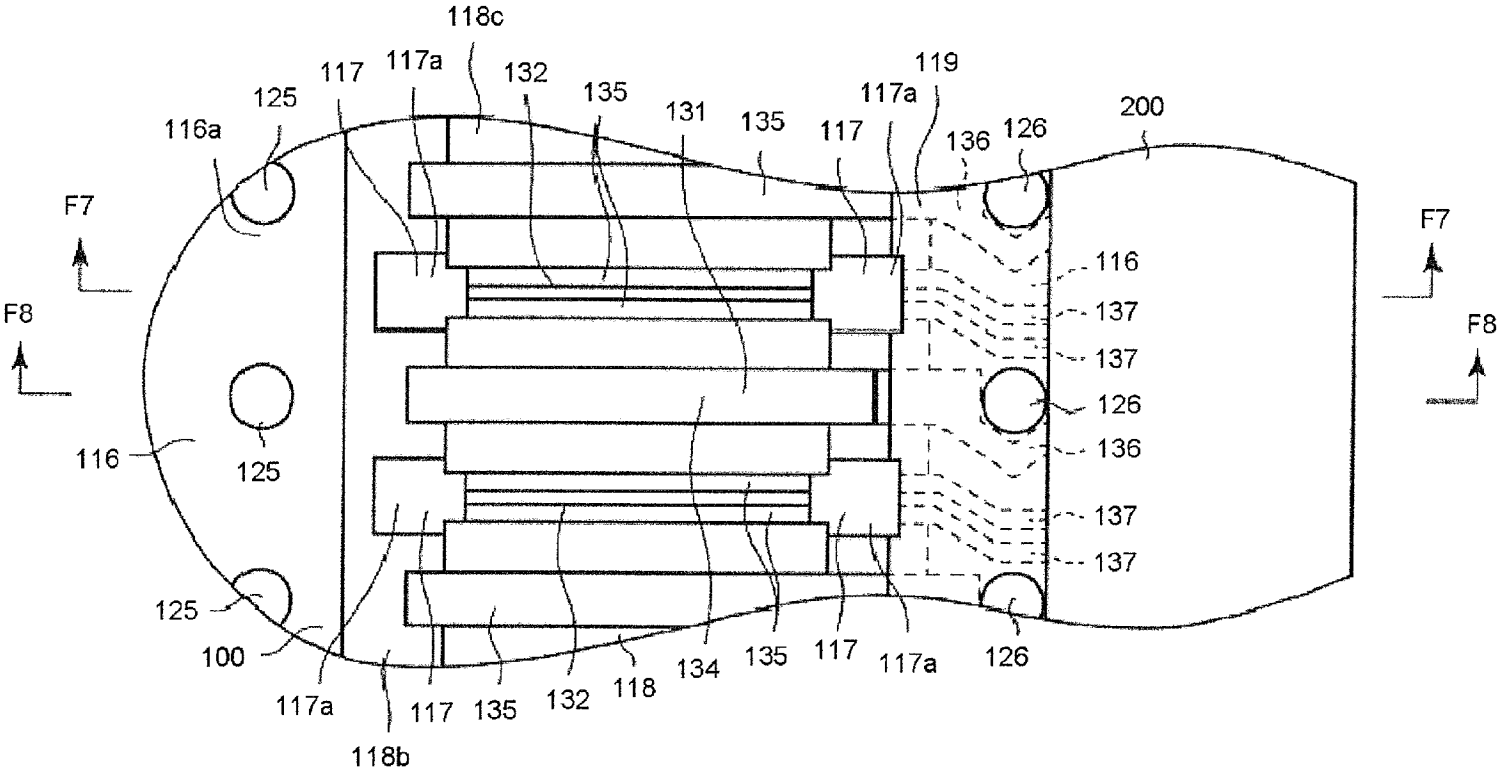
FIG. 6 is a diagram illustrating an example of the configuration of a part of the inkjet head according to the embodiment.
Figure 7:
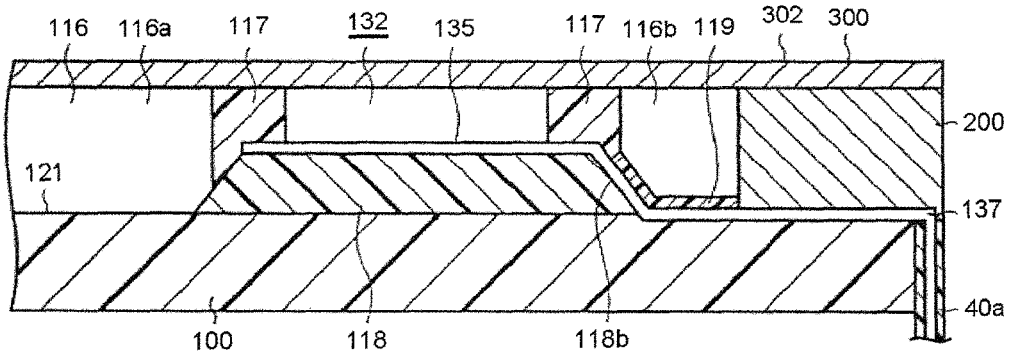
FIG. 7 is a diagram illustrating an example of the configuration of a part of the inkjet head according to the embodiment.
Figure 8:
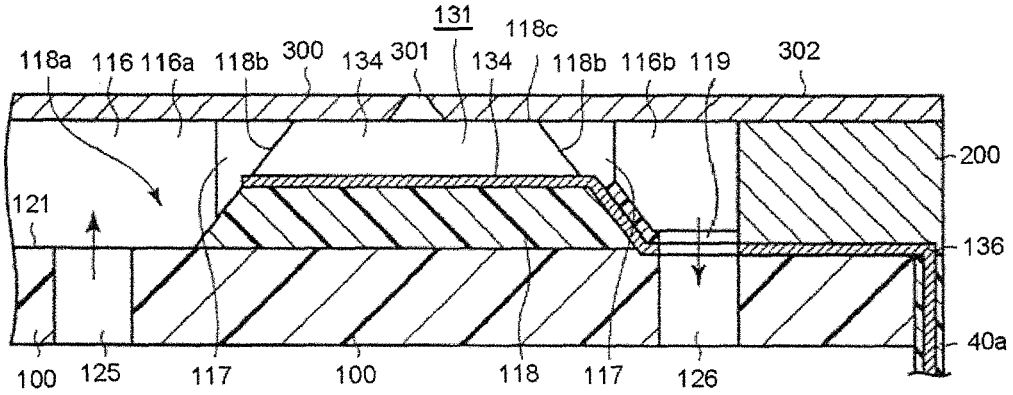
FIG. 8 is a diagram illustrating an example of the configuration of a part of the inkjet head according to the embodiment.

FIG. 6 is a plane view partially enlarging one of the piezoelectric members 118 of the inkjet head 21 shown in FIG. 3. FIG. 7 is a cross-sectional view illustrating the inkjet head shown in FIG. 6 cut off along F7-F7. FIG. 8 is a cross-sectional view illustrating the inkjet head 21 shown in FIG. 6 cut off along F8-F8.

The ink chamber 116 is a space encircled by the mounting surface 121 of the base material 100, the nozzle plate 300 and the frame member 200. The ink chamber 116 contains a first ink chamber 116*a* and a second ink chamber 116*b*. The first ink chamber 116*a* is a space between the two piezoelectric members 118. A plurality of the supply ports 125 communicates with the first ink chamber 116*a*. On the other hand, the second ink chamber 116*b* is a space at the side (outer side) of the frame member 200 of the two piezoelectric members 118. A plurality of the discharge ports 126 is respectively communicates with the second ink chamber 116*b*.

The ink in the ink tank is supplied to the ink chamber 116 through the pump (not shown). At this time, the ink is supplied from the ink tank to the first ink chamber 116*a*. The ink chamber 116 is slowly filled with the supplied ink. Specifically, the ink flowing into the first ink chamber 116*a* flows out towards the two second ink chambers 116*b* through a plurality of the first grooves 131 of the piezoelectric member 118 at the both sides. In this way, the whole of ink chamber 116 encircled by the frame member 200 is filled with the ink. Then, the ink flowing into the second ink chamber 116*b* is returned to the ink tank via a plurality of the discharge ports 126.

As both ends of each of a plurality of the second grooves 132 alternately arranged between a plurality of the first grooves 131 are blocked by the wall materials 117 as shown in FIG. 7, the ink does not enter into the second groove 132. Thus, a plurality of the first grooves 131 functions as a part of the flow path in which the ink circulates; on the other hand, a plurality of the second grooves 132 functions as a dummy chamber into which no ink enters.

Next, the electrodes and the wirings arranged in the base material 100 and the piezoelectric member 118 are described.

As shown in FIG. 5, the first electrode 134 is formed in the first groove 131, and the second electrode 135 is formed in the second groove 132. In the example shown in FIG. 5, one first electrode 134 is formed in one first groove 131, two second electrodes 135 are formed in one second groove 132. The first electrode 134 is formed over a pair of side surfaces 138 and a bottom surface 139 of the first groove 131. Each of the second electrodes 135 is formed over one of side surfaces 140 and a part of a bottom surface 141 of the second groove 132.

As shown in FIG. 6, the first wiring 136 extending to the first groove 131 and the second wiring 137 extending to the second groove 132 are arranged on the base material 100 of the second ink chamber 116*b*. In the example shown in FIG. 6, one first wiring 136 is arranged for each first groove 131, and two second wirings 137 are arranged for each second groove 132. One end of the first wiring 136 is connected with the first electrode 134 formed in the first groove 131, and the other end of the first wiring 136 is connected with the driving circuit 40 shown in FIG. 3 via a flexible wiring board 40*a*. Further, one end of each of the two second wirings 137 is respectively connected with the two second electrodes 135 formed in the second groove 132, and the other end of the second wiring 137 is connected with the driving circuit 40 shown in FIG. 3 via the flexible wiring board 40*a*.

The first electrode 134 and the second electrode 135 respectively arranged in the first groove 131 and the second groove 132 are formed by, for example, a nickel thin film. The material of the first electrode 134 and the second electrode 135 is not limited to this, and the first electrode 134 and the second electrode 135 may be formed by, for example, a Pt (platinum) thin film and an Al (aluminum) thin film, and a Ti (titanium) thin film. Furthermore, the material of the first electrode 134 and the second electrode 135 may be other materials such as Cu (copper), Al (aluminum), Ag (silver), Ti (titanium), W (tungsten), Mo (molybdenum) and Au (gold).

The second wiring 137 connected with the second electrode 135 is covered by an insulating film 119 formed with the insulating material. The insulating film 119 may be arranged to further cover the first wiring 136. The insulating film 119 is arranged to cover a location at which the second wiring 137 connects with the ink filled into the ink chamber 116*b*. Through the configuration, it can be prevented that a potential difference generated between the first electrode 134 and the second wiring 137 or between the plural second wirings 137 is applied to the ink. Further, the insulating film 119 may extend to adhesion parts between the frame member 200 and the first wiring 136 and between the frame member 200 and the second wiring 137.

Through the foregoing configuration, the piezoelectric member 118 can be deformed according to the potential difference between the first electrode 134 arranged in the first groove 131 corresponding to one nozzle and the second electrodes 135 arranged on the side surfaces 140 of the second groove 132 opposite to the first electrode 134 across the piezoelectric member 118. In other words, an actuator that makes the volume of the first groove 131 changed is constituted by the piezoelectric member 118, and the first electrode 134 and the second electrode 135 between which the piezoelectric member 118 is sandwiched. In this way, one channel for ejecting the ink is constituted by the actuator composed of the piezoelectric member 118, the first electrode 134 and the second electrode 135, the first groove 131 in which the ink is filled and the nozzle 301 corresponding to the first groove 131.

Figure 9:
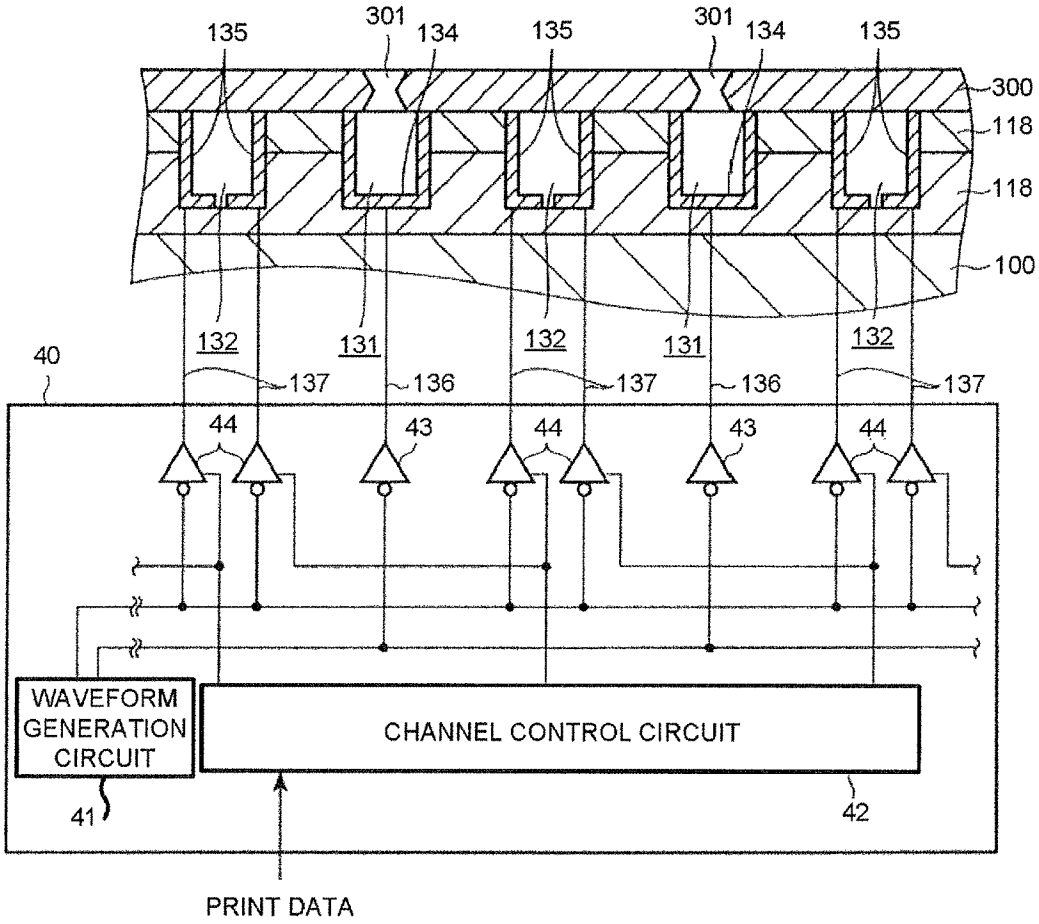
FIG. 9 is a diagram illustrating an example of the configuration of a driving circuit of the inkjet head according to the embodiment.
Figure 10:
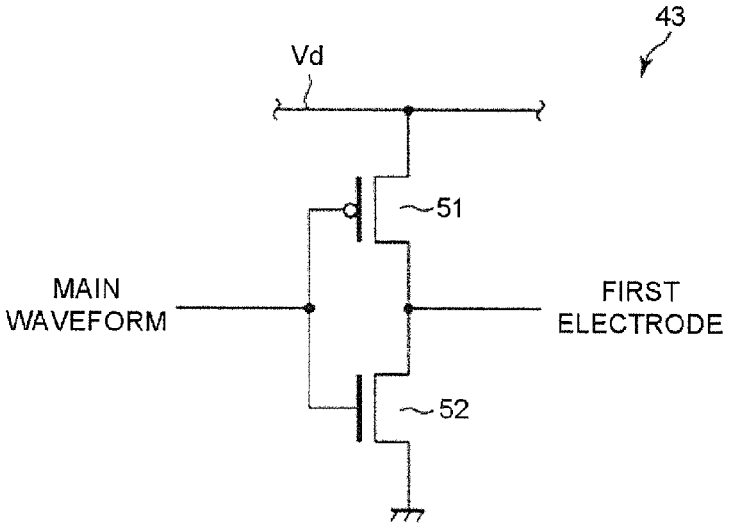
FIG. 10 is a diagram illustrating an example of the configuration of a first driver of the inkjet head according to the embodiment.
Figure 11:
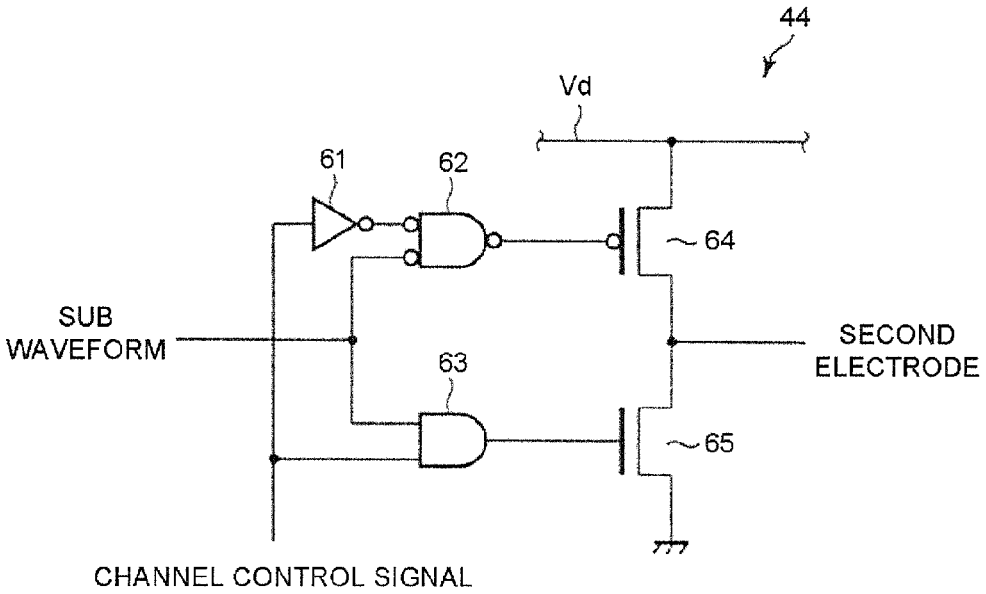
FIG. 11 is a diagram illustrating an example of the configuration of a second driver of the inkjet head according to the embodiment.

Next, the configuration of the driving circuit 40 of the inkjet head 21 is described. FIG. 9 to FIG. 11 are diagrams illustrating the configuration of the driving circuit 40. The driving circuit 40 controls the ejection of the ink from the nozzle 301 for each channel composed of the nozzle 301, the first groove 131 and the actuator that makes the volume of the first groove 131 changed due to the deformation of the first groove 131. Thus, the driving circuit 40, according to the print data, controls the potential difference between the first electrode 134 arranged in the first groove 131 corresponding to one nozzle and the second electrodes 135 arranged on the side surfaces 140 of the second groove 132 opposite to the first electrode 134 across the piezoelectric member 118 for each channel. In this way, the driving circuit 40 drives the actuator constituting the channel according to the print data to change the volume of the first groove 131 to eject the ink from the nozzle 301.

As shown in FIG. 9, the driving circuit 40 includes a waveform generation circuit 41, a channel control circuit 42, a plurality of first drivers 43, and a plurality of second drivers 44. For example, the driving circuit 40 is equipped with the first driver 43 for each first electrode 134, and the second driver 44 for each second electrode 135. In other words, the driving circuit 40 is equipped with one first driver 43 and two second drivers 44 for each channel.

The waveform generation circuit 41 generates a main waveform and a sub waveform and outputs them. The main waveform and the sub waveform are rectangular pulses respectively consisting of a high-level signal and a low-level signal. A terminal for outputting the main waveform generated by the waveform generation circuit 41 is connected with each first driver 43. Further, a terminal for outputting the sub waveform generated by the waveform generation circuit 41 is connected with each second driver 44. In other words, the waveform generation circuit 41 inputs the same main waveform to each first driver 43 and the same sub waveform to each second driver 44. It may be applicable that the waveform generation circuit 41 does not input the same sub waveform to each second driver 44 but inputs different sub waveforms in each channel to the second driver 44.

The channel control circuit 42 switches the state of the second driver 44 between an on-state and an off-state. The channel control circuit 42 generates a channel control signal for each channel according to the print data and inputs the channel control signal to the second driver 44 corresponding to each channel to switch the state of the second driver 44 between the on-state and the off-state for each channel. The channel control signal is a rectangular pulse consisting of a high-level signal and a low-level signal. The channel control circuit 42 inputs the high-level channel control signal to the second driver 44 to switch the state of the second driver 44 to the on-state. On the other hand, the channel control circuit 42 inputs the low-level channel control signal to the second driver 44 to switch the state of the second driver 44 to the off-state.

The channel control circuit 42 switches the state of the second driver 44 corresponding to the channel that ejects the ink to the on-state to eject the ink from the nozzle 301. On the other hand, the channel control circuit 42 switches the state of the second driver 44 corresponding to the channel that does not eject the ink to the off-state. In this way, the channel control circuit 42 applies a voltage to the actuator constituting the channel that ejects the ink to deform the actuator. In this way, the channel control circuit 42 drives the actuator constituting the channel according to the print data to make the volume of the first groove 131 changed to eject the ink from the nozzle 301.

The first driver 43 applies an electric potential to the first electrode 134 according to the input waveform. For example, the first driver 43 functions as a NOT circuit. FIG. 10 is a diagram illustrating an example of the configuration of the first driver 43. For example, the first driver 43 includes a first switching element 51 and a second switching element 52. The first switching element 51 is constituted by, for example, p-MOS. The second switching element 52 is constituted by, for example, n-MOS. Gates of the first switching element 51 and the second switching element 52 are connected with an output terminal of the main waveform of the waveform generation circuit 41. A source of the first switching element 51 is connected with a driving power (not shown) of which the voltage is Vd. A drain of the first switching element 51 is connected with a drain of the second switching element 52 and an output terminal of the first driver 43. The source of the second switching element 52 is connected with GND.

The second driver 44 applies an electric potential to the second electrode 135 according to the input waveform. For example, the second driver 44 functions as a NOT circuit capable of controlling the on-state and the off-state through the channel control signal. FIG. 11 is a diagram illustrating an example of the configuration of the second driver 44. For example, the second driver 44 includes a first logic element 61, a second logic element 62, a third logic element 63, a first switching element 64, and a second switching element 65.

The first logic element 61 is constituted by, for example, a NOT circuit. The second logic element 62 is constituted by, for example, an OR circuit. The third logic element 63 is constituted by, for example, an AND circuit. The first switching element 64 is constituted by, for example, p-MOS. The second switching element 65 is constituted by, for example, n-MOS.

The channel control signal output from the channel control circuit 42 is input to the first logic element 61. The first logic element 61 reverses the channel control signal and outputs the reversed channel control signal.

The output of the first logic element 61 and the sub waveform output from the waveform generation circuit 41 are input to the second logic element 62. The second logic element 62 outputs a logical sum (logical product of negative logic) of the output of the first logic element 61 and the sub waveform.

The channel control signal output from the channel control circuit 42 and the sub waveform output from the waveform generation circuit 41 are input to the third logic element 63. The third logic element 63 outputs a logical product of the channel control signal and the sub waveform.

A gate of the first switching element 64 is connected with an output terminal of the second logic element 62. A gate of the second switching element 65 is connected with an output terminal of the third logic element 63. A source of the first switching element 64 is connected with the driving power (not shown) of which the voltage is Vd. A drain of the first switching element 64 is connected with a drain of the second switching element 65 and the output terminal of the second driver 44. A source of the second switching element 65 is connected with GND.

The configurations of the first driver 43 and the second driver 44 are not limited to the above. The configurations of the first driver 43 and the second driver 44 may be optional as long as a truth-value similar to that obtained by the foregoing configuration can be obtained.

Next, the operations of the inkjet head 21 are described.

For example, in a case in which a print instruction is received, the main control section 31 generates the print data and inputs the generated print data to the driving circuit 40 of the inkjet head 21 via the print data output section 35.

Further, the ink supply section 36 supplies the ink in the ink tank to the inkjet head 21 through the tube and a plurality of the supply ports 125 in response to the control of the main control section 31. The ink supplied to the inkjet head 21 through the supply port 125 flows into the first groove 131 from one end of the first groove (pressure chamber) 131 communicating with the first ink chamber 116*a*. The ink flowing out from the first groove 131 flows into the second ink chamber 116*b*. The ink flowing out to the second ink chamber 116*b* is discharged to the ink tank via a plurality of the discharge ports 126.

The supply amount and the discharge amount of the ink supplied to the ink chamber 116 are adjusted to values at which air bubbles inside the ink chamber 116 are discharged from the discharge ports 126 while the ink is not pushed out from the nozzle 301. The ink is not retained in the ink chamber 116 but circulated between the ink chamber 116 and the ink tank through the supply port 125 and the discharge port 126.

The driving circuit 40 applies electric potentials to the first electrode 134 and the second electrode 135 to generate the potential difference between the first electrode 134 and the second electrode 135 to drive the actuator of each demanded channel corresponding to the received print data.

Figure 12:
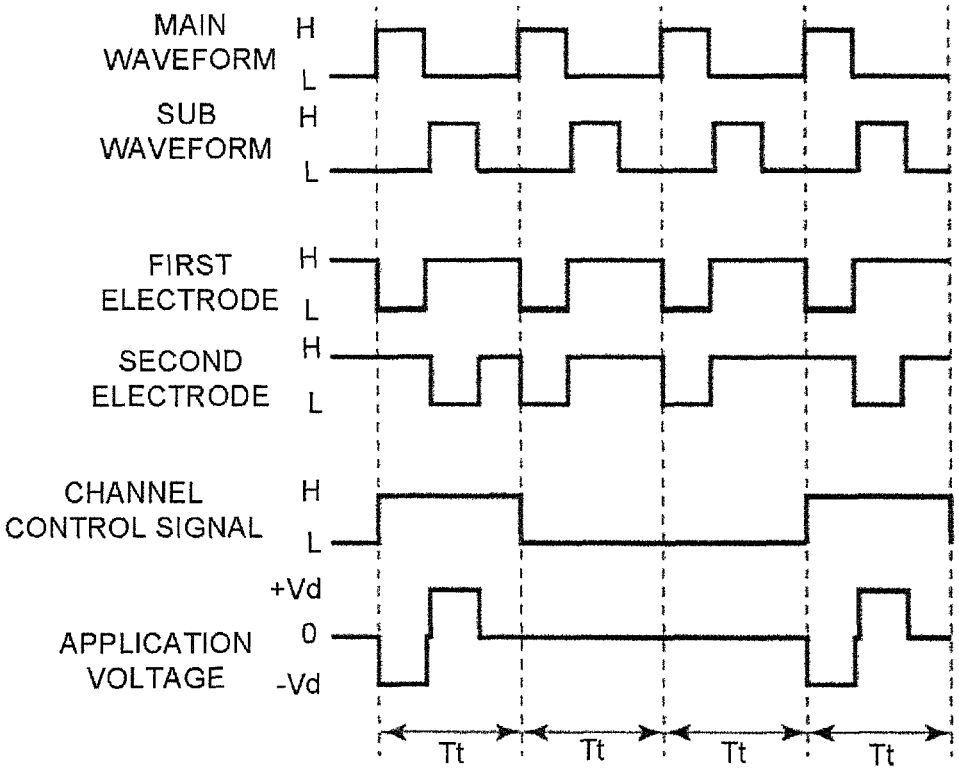
FIG. 12 is a diagram illustrating an example of the operations of the inkjet head according to the embodiment.

FIG. 12 is a timing chart illustrating each signal of the driving circuit 40 and an application voltage of the actuator. Time Tt shown in FIG. 12 refers to time required for the ejection of the ink. The time Tt contains preparation time for the ejection of the ink, ejection time of the ink and time for a post processing. In FIG. 12, a difference between the electric potential of the second electrode 135 and the electric potential of the first electrode 134 is shown as the application voltage applied to the actuator.

The main waveform generated by the waveform generation circuit 41 is set to high level at a timing equivalent to the preparation time for the ejection of the ink in one single time Tt. The sub waveform generated by the waveform generation circuit 41 is set to high level at a timing equivalent to the ejection time of the ink in one single time Tt. Further, the channel control signal generated by the channel control circuit 42 takes time equivalent to the time Tt as the minimum unit and the level of the channel control signal is switched between the high level and the low level.

In a case in which the main waveform is the high level, the first driver 43 decreases the electric potential of the first electrode 134 connected with the output terminal to the GND. On the other hand, in a case in which the main waveform is the low level, the first driver 43 increases the electric potential of the first electrode 134 connected with the output terminal to the voltage Vd of the driving power.

Further, in a case in which the channel control signal is the high level and the sub waveform is the high level, the second driver 44 decreases the electric potential of the second electrode 135 connected to the output terminal to the GND. On the other hand, in a case in which the channel control signal is the high level and the sub waveform is the low level, the second driver 44 increases the electric potential of the second electrode 135 connected with the output terminal to the voltage Vd of the driving power. In a case in which the channel control signal is the low level, the second driver 44 opens the second electrode 135 connected with the output terminal regardless of the high level and the low level of the sub waveform. In this case, the electric potential of the second electrode 135 is increased or decreased to an electric potential equal to that of the first electrode 134 driven by the main waveform output from the first driver 43 via electrostatic capacitance of the piezoelectric member 118. In other words, in a case in which the channel control signal is the low level, the electric potential of the second electrode 135 follows an electric potential of the first electrode 134.

The potential difference obtained by subtracting the electric potential of the second electrode 135 from the electric potential of the first electrode 134 controlled in this way is the application voltage applied to the actuator.

As a result, as shown in FIG. 12, in the channel of which the channel control signal is the high level, at a timing when the main waveform is the high level and the sub waveform is the low level, the electric potential of the first electrode 134 is decreased to the GND, and the electric potential of the second electrode 135 is increased to the voltage Vd. Consequentially, an application voltage −Vd is applied to the actuator composed of the first electrode 134, the second electrode 135 and the piezoelectric member 118 therebetween.

If the application voltage −Vd is applied to the actuator, the actuator bends from the first electrode 134 side to the second electrode 135 side. That is, the side walls 133 constituting the side surfaces 138 of the first grooves 131 respectively bend from the first groove 131 side to the second groove 132 side. In this way, the volume of the first groove 131 is increased, and the pressure in the first groove 131 is decreased. As a result, the ink flows from the first ink chamber 116*a* into the first groove 131.

Further, in the channel of which the channel control signal is the high level, at a timing the main waveform is the low level and the sub waveform is the high level, the electric potential of the first electrode 134 is increased to the voltage Vd, and the electric potential of the second electrode 135 is decreased to the GND. As a result, an application voltage +Vd is applied to the actuator composed of the first electrode 134, the second electrode 135 and the piezoelectric member 118 therebetween.

If the application voltage +Vd is applied to the actuator, the actuator bends from the second electrode 135 side to the first electrode 134 side. That is, the side walls 133 constituting the side surfaces 138 of the first grooves 131 respectively bend from the second groove 132 to the first groove 131. In this way, the volume of the first groove 131 is decreased, and the pressure in the first groove 131 is increased. As a result, the ink in the first groove 131 is ejected from the nozzle 301 communicating with the first groove 131.

On the other hand, in the channel of which the channel control signal is the low level, no potential difference is applied to the actuator regardless of the levels of the main waveform and the sub waveform as the electric potential of the second electrode 135 follows that of the first electrode 134, no ink is ejected. In this way, the ink can be ejected only from the channel selected by the channel control signal on demand.

Next, the action effect of the inkjet head according to the present embodiment is described.

According to the above-mentioned configuration, the inkjet head respectively applies the electric potential to a plurality of the first electrodes arranged in each channel through a plurality of the first drivers arranged for each first electrode, and applies the electric potential to a plurality of the second electrodes arranged to face the first electrodes across the piezoelectric member through a plurality of the second drivers corresponding to the second electrodes. In other words, the inkjet head does not apply the electric potential to each first electrode via a common electrode from one driver, but independently applies the electric potential to each first electrode and each second electrode for each channel from a set of each first driver and each second driver arranged in each first electrode and each second electrode. In this way, a common impedance part for commonly applying the driving waveform to each piezoelectric member is excluded. Thus, the problem that the driving waveforms input to the electrode are different depending on the content of the print data occurred in the conventional driving circuit as voltage drops are different according to the number of the piezoelectric members that are driven simultaneously. The problem is solved by the aforementioned first and second drivers. As a result, the inkjet head can stably print regardless of the print content. Further, uneven density and deterioration of print quality can be suppressed and reliability of print can be improved.

Further, manufacturing cost of the inkjet head can be suppressed because it is unnecessary to tridimensionally wire the common electrode by providing the first driver for each first electrode.

The inkjet head can control the operations of the actuator in three stages through the combination of the electric potentials applied to the first electrode and the second electrode. In other words, the inkjet head can drive the actuator with an amplitude equivalent to 0 times, one time and two times of the voltage of the driving power of the first driver and the second driver. Through assuming the driving voltage of the actuator to be two times at the maximum of the voltage of the driving power, even if the voltage of the driving power is low, the large driving amplitude of the actuator can be obtained, that is, voltage efficiency is improved. Further, by controlling the operations of the actuator in three stages, ejection property relating to print quality and printing speed such as an ejection speed, an ejection volume, damping after ejection and the like can be adjusted efficiently and minutely.

The inkjet head can set the electric potentials in the first electrodes to the same value by driving the first drivers that apply the electric potentials to the first electrodes with the common main waveform. In other words, it is applicable in the inkjet head that no potential difference occurs in different first electrodes. In this way, the inkjet head can prevent the potential difference from being applied to the ink through the first electrode. Further, the inkjet head is equipped with the wall material that prevents the ink from flowing into the second groove in which the second electrode is arranged. In this way, the inkjet head can prevent the potential difference from being applied to the ink through the second electrode. The inkjet head constituted in this way can prevent the occurrence of electrochemical reaction in the ink by applying the potential difference to the ink.

In the foregoing embodiment, it is described in the inkjet head 21 that a pair of the side walls 133 constituting a pair of the side surfaces 138 of the first groove 131 are separately constituted as the actuator; however, the prevent invention is not limited to this. In the inkjet head, one of a pair of the side walls 133 constituting a pair of the side surfaces 138 of the first groove 131 may be constituted as the actuator.

In the foregoing embodiment, it is described that the first electrode 134 of the inkjet head 21 is formed over a pair of the side surfaces 138 and the bottom surface 139 of the first groove 131; however, the prevent invention is not limited to this. The first electrode 134 may be separately formed on the whole or part of a pair of the side surfaces 138 of the first groove 131. In this case, the first electrode 134 separately formed on a pair of the side surfaces 138 of the first groove 131 of each channel is connected with the output terminal of the first driver 43 corresponding to the channel through the first wiring 136.

In FIG. 9, the driving circuit 40 of the inkjet head 21 applies the same electric potential to two second electrodes 135 facing to one first electrode 134 in one channel with two commonly controlled second driver 44; however, the prevent invention is not limited to this. The driving circuit 40 may provide each single driver 44 for commonly driving the two second electrodes 135.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An inkjet head, comprising:

a piezoelectric member comprising, alternately, a plurality of pressure chambers (first grooves) and a plurality of air chambers (second grooves), wherein each of the pressure chambers and the air chambers comprise both side surfaces and a bottom surface formed within the piezoelectric member;

a nozzle plate configured to block a surface of the piezoelectric member on which a nozzle is arranged at least in accordance with a position of each pressure chamber;

an ink chamber configured to communicate with each pressure chamber to supply ink only thereto;

a first electrode formed over the side surfaces of each pressure chamber;

a second electrode formed on each side surface of each air chamber; and a driving circuit comprising a first driver, wherein such first driver is configured to input a common first driving waveform to each first electrode, and a plurality of second drivers configured to input a second driving waveform based on print data to a pair of the second electrodes each sandwiching the piezoelectric member with the first electrode.

2. The inkjet head according to claim 1, wherein each of the second drivers is configured to receive a channel-control-signal which controls the second driver to switch on and off.

3. The inkjet head according to claim 2, wherein the channel-control-signal is generated in accordance with the print data.

4. The inkjet head according to claim 1, wherein the ink only contacts the first electrode.

5. The inkjet head according to claim 1, wherein the pressure chamber is a gap into which ink flows.

6. An inkjet printing method for the inkjet head of claim 1, simultaneously comprising:

the plurality of first drivers inputting the common first driving waveform to each of a plurality of first electrodes; and the plurality of second drivers inputting the second driving waveform to each pair of the second electrodes.

7. The inkjet printing method according to claim 6, wherein the second driving waveform corresponds to print data.

8. The inkjet printing method according to claim 6, wherein the common first driving waveform comprises a main waveform and the second driving waveform comprises a sub waveform.

9. The inkjet printing method according to claim 6, wherein the common first driving waveform comprises a main waveform and the second driving waveform comprises a plurality of sub waveforms different from each other.

10. The inkjet printing method according to claim 6, further comprising contacting the first electrode with the ink.

11. An inkjet recording apparatus, comprising:

an inkjet head; and a conveyance device configured to convey a recording paper to a position opposite a nozzle, the inkjet head further comprising:

a piezoelectric member comprising a plurality of pressure chambers arranged alternately with a plurality of air chambers, wherein each pressure chamber and each air chamber comprise side surfaces and a bottom surface formed on a surface of the piezoelectric member;

a nozzle plate comprising a plurality of nozzles the nozzle plate configured to block the surface of the piezoelectric member on which each nozzle is arranged at least in accordance with a position of each pressure chamber;

an ink chamber configured to communicate with each pressure chamber to supply ink thereto;

a first electrode formed on each side surface of each pressure chamber;

a second electrode formed on each side surface of each air chamber; and a driving circuit comprising a first driver configured to input a common first driving waveform to each first electrode, and a plurality of second drivers configured to input a second driving waveform based on print data to a pair of the second electrodes wherein each pair of second electrodes sandwiches the piezoelectric member with the first electrode.

12. The inkjet recording apparatus according to claim 11, wherein each of the second drivers is configured to receive a channel-control-signal which controls the second driver to switch on and off.

13. The inkjet recording apparatus according to claim 12, wherein the channel-control-signal is generated in accordance with the print data.

14. The inkjet recording apparatus according to claim 11, wherein the first electrode contacts the ink and the second electrode does not contact the ink.

15. The inkjet recording apparatus according to claim 11, wherein the air chamber is a gap into which no ink flows.

* * * * *